US011325161B2

(12) United States Patent
Mayer

(10) Patent No.: US 11,325,161 B2
(45) **Date of Patent: *May 10, 2022**

(54) INLET DOOR FLOOD GATE MATERIAL SPREADER

(71) Applicant: M-I L.L.C., Houston, TX (US)

(72) Inventor: Marc Mayer, Burlington, KY (US)

(73) Assignee: Schlumberger Technology Corporation, Sugar Land, TX (US)

( * ) Notice: Subject to any disclaimer, the term of this patent is extended or adjusted under 35 U.S.C. 154(b) by 127 days.

This patent is subject to a terminal disclaimer.

(21) Appl. No.: 16/719,827

(22) Filed: Dec. 18, 2019

(65) Prior Publication Data

US 2021/0187553 A1 Jun. 24, 2021

(51) Int. Cl.
*B07B 13/16* (2006.01)
*B07B 1/38* (2006.01)

(52) U.S. Cl.
CPC ..... *B07B 13/16* (2013.01); *B07B 1/38* (2013.01); *B07B 2201/04* (2013.01)

(58) Field of Classification Search
CPC ..... B07B 1/36; B07B 1/38; B07B 2201/04
USPC ..... 209/243
See application file for complete search history.

(56) References Cited

U.S. PATENT DOCUMENTS

| | | | | |
|---|---|---|---|---|
| 2,236,934 | A * | 4/1941 | Benedict | B07B 1/38 209/257 |
| 3,688,902 | A * | 9/1972 | Hubach | B07B 13/04 209/240 |
| 4,322,288 | A * | 3/1982 | Schmidt | B02B 1/02 209/240 |
| 8,636,150 | B1 * | 1/2014 | Akers, Jr. | B07B 1/282 209/314 |
| 2012/0018548 | A1 * | 1/2012 | Andela | B03B 9/062 241/24.19 |
| 2013/0220945 | A1 * | 8/2013 | Carr | E21B 21/01 210/768 |
| 2014/0166592 | A1 * | 6/2014 | Holton | B07B 1/40 210/780 |
| 2016/0356108 | A1 * | 12/2016 | Kutryk | B07B 1/46 |
| 2019/0047022 | A1 * | 2/2019 | Meranda | B07B 1/28 |
| 2019/0054502 | A1 * | 2/2019 | Mayer | B07B 13/16 |

* cited by examiner

*Primary Examiner* — Terrell H Matthews
(74) *Attorney, Agent, or Firm* — Jeff Frantz

(57) ABSTRACT

A deck inlet for a sifter includes a pan and a spreader. The pan is oriented at an angle from about 2° to about 20° with respect to a horizontal plane. The spreader is coupled to or integral with an upper surface of the pan. The spreader is configured to spread a material substantially evenly across a width of the pan.

19 Claims, 7 Drawing Sheets

INLET DOOR FLOOD GATE MATERIAL SPREADER

BACKGROUND

Gyratory equipment, including gyratory sifters, may be used as a mechanical screen or sieve. Gyratory equipment can be adapted to screen both wet and dry materials. Gyratory sifters may be employed in the hydraulic fracturing, oil, construction, mining, food, chemical, pharmaceutical, and plastics industries among others.

Gyratory equipment may include one or more sets of screens. The screens may be arranged vertically, one on top of the other. The screens may be removable and interchangeable, such that different sets of screens may be used for different applications, and worn or damaged screens may be replaced. Generally, the screens may contain different mesh sizes, where the coarsest (e.g., largest mesh size) screen is nearest to the input, and the finest (e.g., smallest mesh size) is nearest to the final output. A gyratory sifter may have several outputs depending on the application (e.g., one output for each screen), such that the materials unable to pass through each screen may be separately outputted and thus sorted.

An input or feed mechanism may be located at or near the top of a gyratory sifter, (e.g., above or adjacent to the topmost and coarsest screen). When input material is introduced into the gyratory sifter, gyratory motion and gravity enable particles smaller than the mesh size of the screen to move through the screen to the next screen deck below, while the materials too large to fit through the mesh are separated out.

Gyratory equipment may include a system of eccentric weights. For example, a gyratory sifter may include a top weight and a bottom weight. The top weight may be coupled to a motor, which rotates the top weight in a plane that is close to the center of the mass of assembly. This may cause vibration and movement of the screens in the horizontal plane, which may cause material input to the screen surface to spread across the screen from the middle to the periphery or outer edges of the screen (i.e., the width of the screen). Such movement may move material too large to pass through the screen to be output and thus removed from the screen surface. A bottom eccentric weight may rotate below the center of mass and create a tilt on the screen surface. The tilt on the screen surface may cause vibration in a vertical and tangential plane. Such movement may induce particles smaller than the mesh size to pass through the screen surface at a more rapid pace and may encourage particles only slightly smaller than the mesh size to find the correct alignment for passing through the screen, thus increasing turnover. Horizontal or vertical motion may be amplified through spring assemblies.

However, the vibration of the screen may not cause the material to spread across the full width of the screen. As a result, parts of the screen may be unused, and the gyratory equipment may not be operating at full efficiency.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A deck inlet for a sifter is disclosed. The deck inlet includes a pan and a spreader. The pan is oriented at an angle from about 2° to about 20° with respect to a horizontal plane. The spreader is coupled to or integral with an upper surface of the pan. The spreader is configured to spread a material substantially evenly across a width of the pan.

A gyratory sifter is also disclosed. The gyratory sifter includes a housing. An upper deck and a lower deck are positioned at least partially within the housing. The upper deck includes an upper deck inlet. The upper deck inlet includes a pan that is oriented at an angle from about 2° to about 20° with respect to a horizontal plane. The upper deck inlet also includes a spreader coupled to or integral with an upper surface of the pan. The spreader is substantially V-shaped and faces an upstream end of the pan. The upper deck also includes a first upper screen positioned downstream from the upper deck inlet. The spreader is configured to spread a material substantially evenly across a width of the first upper screen. The upper deck also includes a first lower screen positioned at least partially below the first upper screen. The lower deck is positioned at least partially within the housing and below the upper deck. The lower deck includes a lower deck inlet, a second upper screen positioned downstream from the lower deck inlet, and a second lower screen positioned at least partially below the second upper screen. The gyratory sifter also includes a motion generator positioned at least partially within the housing. The motion generator is configured to cause the upper deck and the lower deck to move.

A method for sifting a material is also disclosed. The method includes receiving the material via a housing inlet of a vibratory sifter. The method also includes causing at least a portion of the vibratory sifter to move. The method also includes distributing the material from the housing inlet to an upper deck of the vibratory sifter and a lower deck of the vibratory sifter. The upper deck and the lower deck each include a pan, a spreader, and a screen. The method also includes spreading the material across a width of the screen of the upper deck using the spreader of the upper deck. The method also includes sifting the material using the screen of the upper deck to produce a first portion of the material and a second portion of the material.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Illustrative examples of the subject matter claimed below will now be disclosed. In the interest of clarity, not all features of an actual implementation are described in this specification. It will be appreciated that in the development of any such actual implementation, numerous implementation-specific decisions may be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

Further, as used herein, the article "a" is intended to have its ordinary meaning in the patent arts, namely "one or more." Herein, the term "about" when applied to a value generally means within the tolerance range of the equipment used to produce the value, or in some examples, means plus or minus 10%, or plus or minus 5%, or plus or minus 1%, unless otherwise expressly specified. Further, herein the term "substantially" as used herein means a majority, or almost all, or all, or an amount with a range of about 51% to about 100%, for example. Moreover, examples herein are intended to be illustrative only and are presented for discussion purposes and not by way of limitation.

Figure 1:
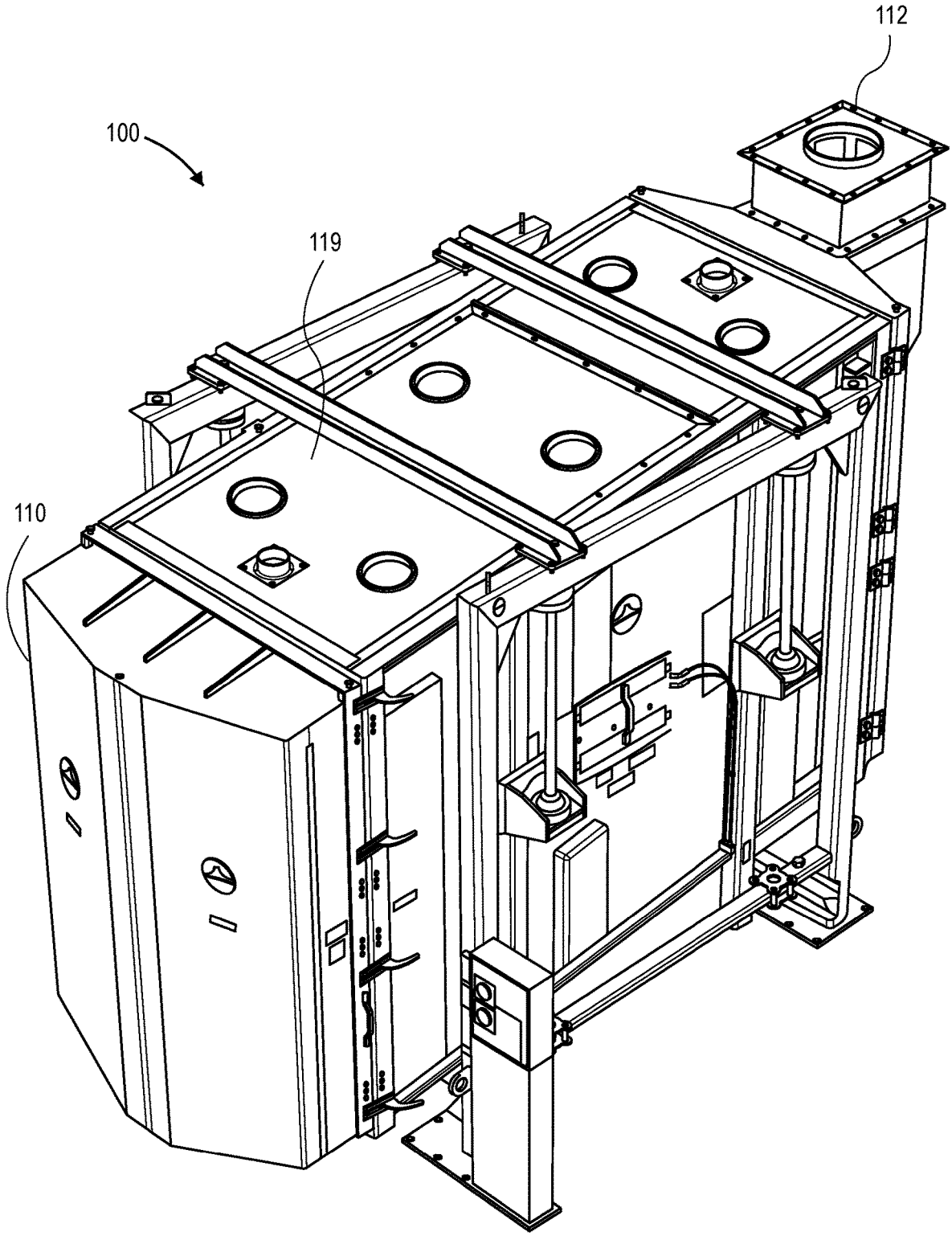
FIG. 1 illustrates a perspective view of an example of a gyratory sifter, according to an embodiment.
Figure 3:
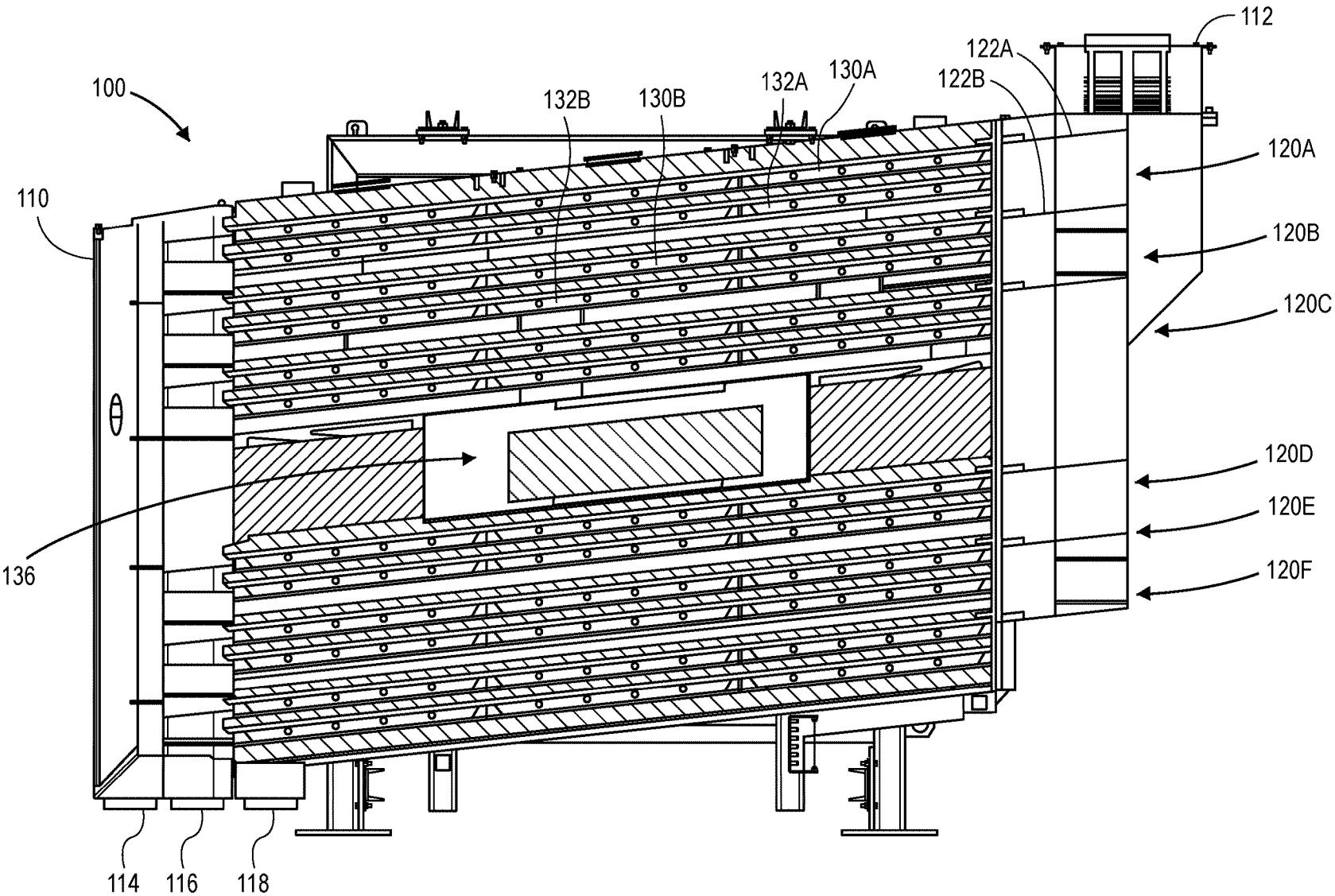
FIG. 3 illustrates a cross-sectional side view of the gyratory sifter, according to an embodiment.

FIG. 1 illustrates a perspective view of an example of a gyratory sifter 100, according to an embodiment. The gyratory sifter 100 may include a housing 110. The housing 110 may have one or more housing inlets (one is shown: 112) and one or more housing outlets (three are shown in FIG. 3: 114, 116, 118). As described in greater detail below, a material may be introduced into the housing 110 via the housing inlet 112. Illustrative materials may include, but are not limited to, frac sand, resin coated sand, ceramic proppant, activated carbon, fertilizer, limestone, petroleum coke, plastic pellets, polyvinyl chloride (PVC) powder, metallic powders, ceramic powders, roofing granules, salt, sugar, and grain. The material may be sifted within the housing 110 into one or more portions (e.g., three portions), as described below.

Figure 2:
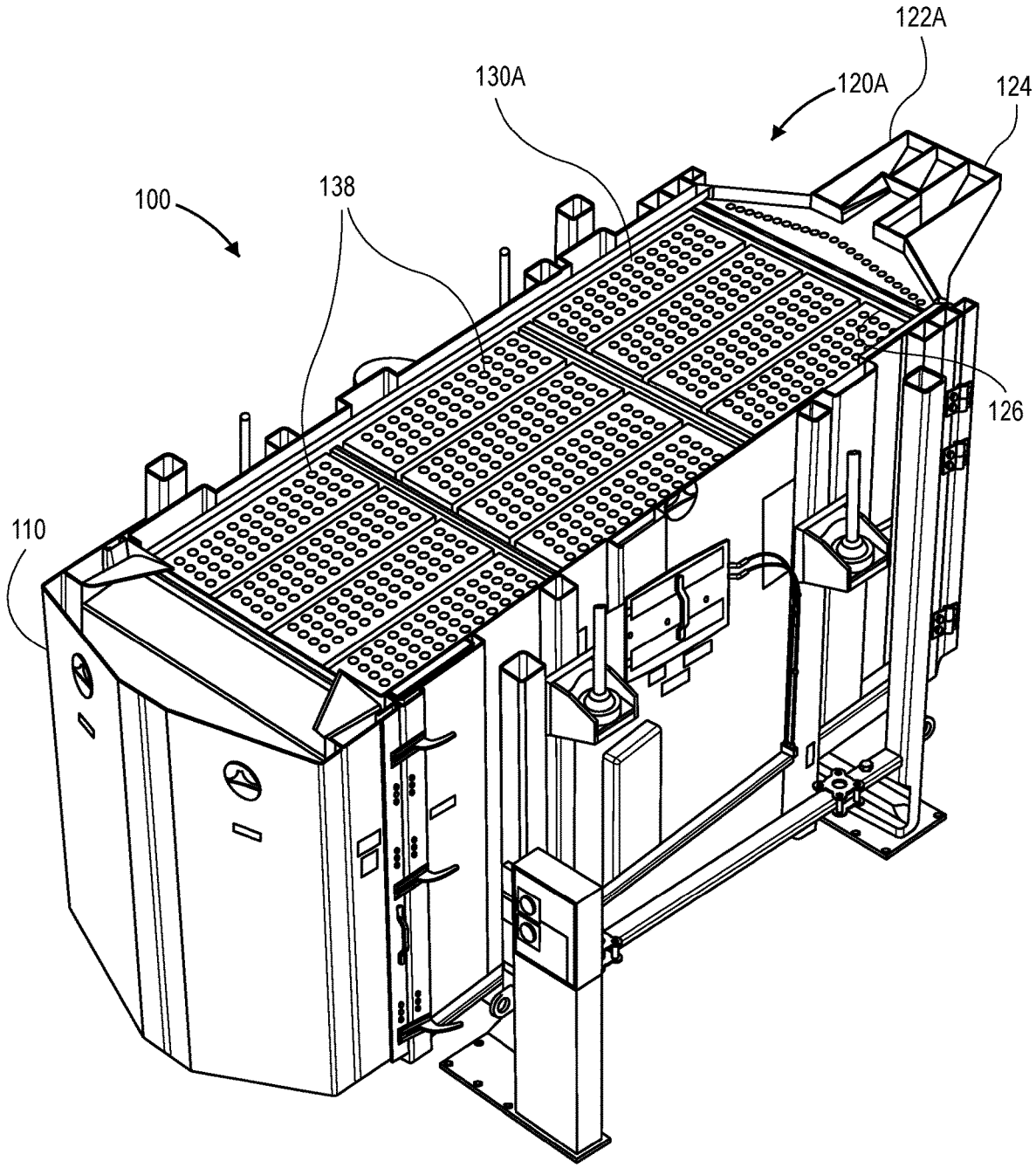
FIG. 2 illustrates a perspective view of the gyratory sifter with an upper panel removed, according to an embodiment.

FIG. 2 illustrates a perspective view of the gyratory sifter 100 with an upper panel 119 (shown in FIG. 1) removed, according to an embodiment. The gyratory sifter 100 may also include one or more decks (an upper deck is shown: 120A). The upper deck 120A may be positioned at least partially within the housing 110. The upper deck 120A may include an upper deck inlet 122A and one or more screens (an upper screen is shown: 130A). As described in greater detail below, at least a portion of the material may flow from the housing inlet 112 to the upper deck inlet 122A, and the material may then flow from the upper deck inlet 122A onto the upper screen 130A. Thus, the upper deck inlet 122A may have an upstream end 124 distal to the upper screen 130A, and a downstream end 126 proximate to the upper screen 130A.

FIG. 3 illustrates a cross-sectional side view of the gyratory sifter 100, according to an embodiment. As may be seen, the upper deck 120A may also include a lower screen 132A positioned at least partially below the upper screen 130A. In another embodiment, the upper deck 120A may include three or more screens arranged in a vertically-stacked manner. The screens 130A, 132A may each include a frame and a wire mesh. The wire meshes may include a plurality of openings. The wire mesh of the upper screen 130A may have relatively larger openings 138 (e.g., a larger mesh size), and the wire mesh of the lower screen 132A may have relatively smaller openings (e.g., a smaller mesh size).

The solid particles in the material that are too large to pass through the openings 138 in the upper screen 130A are directed to the first housing outlet 114. These solid particles are referred to as the overs. Thus, the first housing outlet 114 may also be referred to as the overs housing outlet. The solid particles in the material that pass through the openings 138 in the upper screen 130A but are too large to pass through the openings in the lower screen 132A are directed to the second housing outlet 116. These solid particles are referred to as the unders. Thus, the second housing outlet 116 may also be referred to as the unders housing outlet. The solid particles (and liquid if present) in the material that pass through the openings 138 in the upper screen 130A and the lower screen 132A are directed to the third housing outlet 118. These solid particles are referred to as the fines. Thus, the third housing outlet 118 may also be referred to as the fines housing outlet.

In addition, the gyratory sifter 100 may include a lower deck 120B. The lower deck 120B may be positioned at least partially within the housing 110. The lower deck 120B may be positioned at least partially below the upper deck 120A. More particularly, the lower deck 120B may be positioned at least partially below the lower screen 132A of the upper deck 120A. The lower deck 120B may include a lower deck inlet 122B and one or more screens (an upper screen 130B and a lower screen 132B are shown).

As described in greater detail below, a portion of the material may flow from the housing inlet 112 to the upper deck inlet 122A, and another portion of the material may flow from the housing inlet 112 to the lower deck inlet 122B. In one example, the material may be split into substantially equal portions using the splitter shown and described in U.S. Patent Publication No. 2019/0054502, which is incorporated by reference herein in its entirety to the extent that it is not inconsistent with the present description. The splitter may be positioned at least partially within the housing inlet 112. The splitter may include a bottom surface and a side wall coupled to the bottom surface. The side wall may extend perpendicularly away from the bottom surface. The bottom surface and the side wall may define a reservoir. The side wall may include one or more openings, and each opening may be of substantially equal area to distribute a substantially equal portion of the material to each deck.

The gyratory sifter 100 may also include a motion generator 136 positioned at least partially within the housing 110. The motion generator 136 may cause the decks 120A, 120B to move. More particularly, the motion generator 136 may cause the deck inlets 122A, 122B and the screens 130A, 132A, 130B, 132B to vibrate in one or more directions, which may facilitate the sifting (e.g., filtering) of the material. The upper and lower decks 120A, 120B may operate in parallel to sift (e.g., filter) the material into the overs, the unders, and the fines. The gyratory sifter 100 may also include one or more additional decks (four are shown: 120C-120F) in a vertically-stacked manner, which may be configured to operate in parallel with the decks 120A, 120B. For the sake of simplicity, the decks 120B-120F are not described in detail below.

Figure 4:
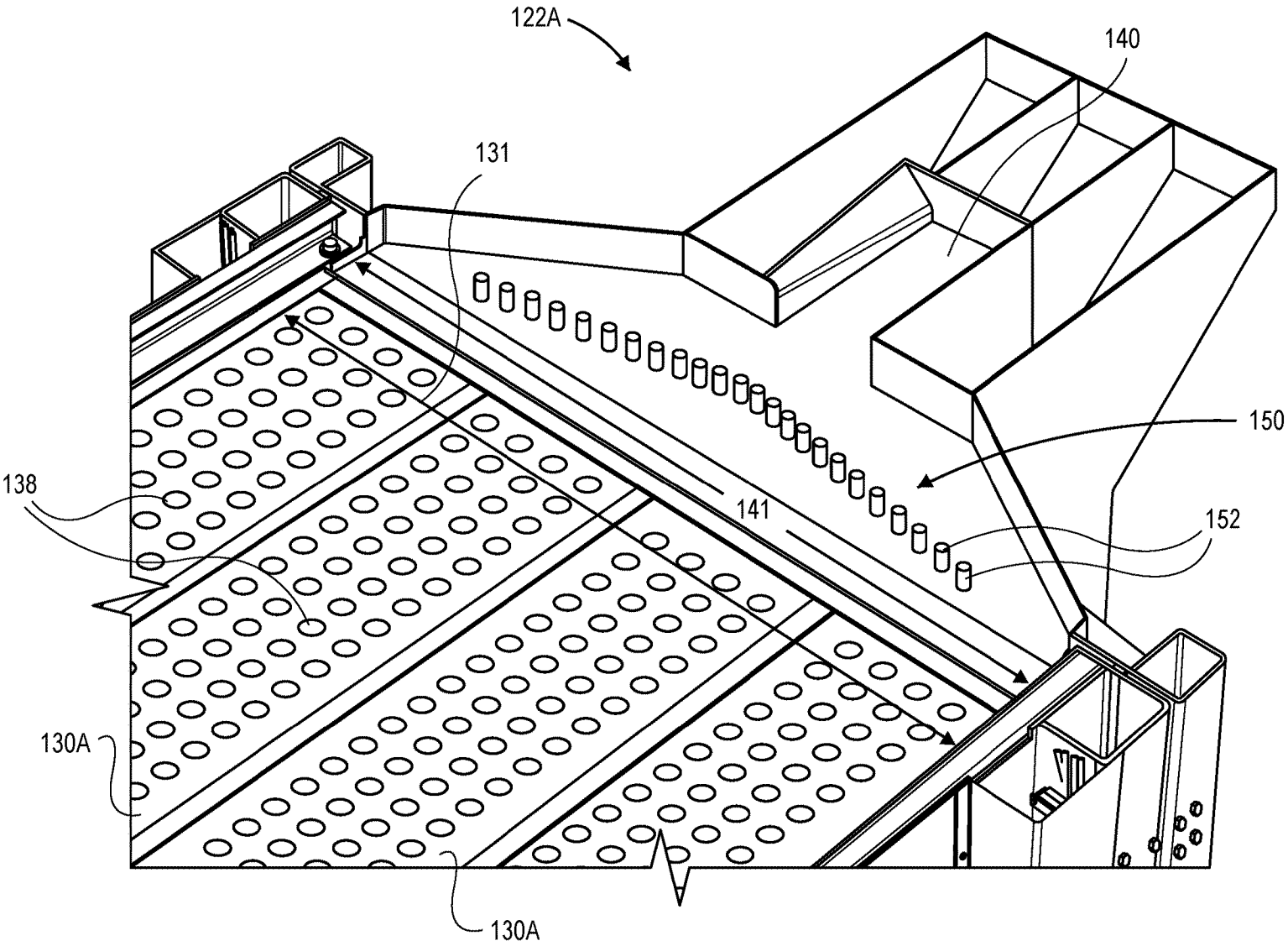
FIG. 4 illustrates an enlarged view of an upper deck inlet of the gyratory sifter, according to an embodiment.

FIG. 4 illustrates an enlarged perspective view of the upper deck inlet 122A, according to an embodiment. The upper deck inlet 122A may include a pan (also referred to as a bottom pan) 140 that is tilted or sloped, which may cause the material to flow down the pan 140 toward and/or onto the upper screen 130A.

The upper deck inlet 122A may also include a spreader 150 that is coupled to or integral with an upper surface of the pan 140. The spreader 150 may serve to spread the material substantially evenly across a width 141 of the pan 140 and/or a width 131 of the upper screen 130A. In one embodiment, "substantially evenly" refers to even volumetric portions+/−10% on each quadrant of the width 131 or 141. For example, the material may be spread substantially evenly when each quadrant receives from 15% to 35% of the material. In another embodiment, "substantially evenly" refers to even volumetric portions+/−5% on each quadrant of the width 131 or 141. For example, the material may be spread substantially evenly when each quadrant receives from 20% to 30% of the material.

In the embodiment shown, the spreader 150 may be or include a plurality of studs 152 that extend upwardly from the pan 140, and the material may flow between and/or over the studs 152. In another embodiment, the spreader 150 may be or include a single barrier with bores formed therethrough, and the material may flow through the bores and/or over the barrier. In yet another embodiment, the spreader 150 may be or include a single solid barrier (i.e., with no bores formed therethrough), and the material may flow over the barrier.

Figure 5:
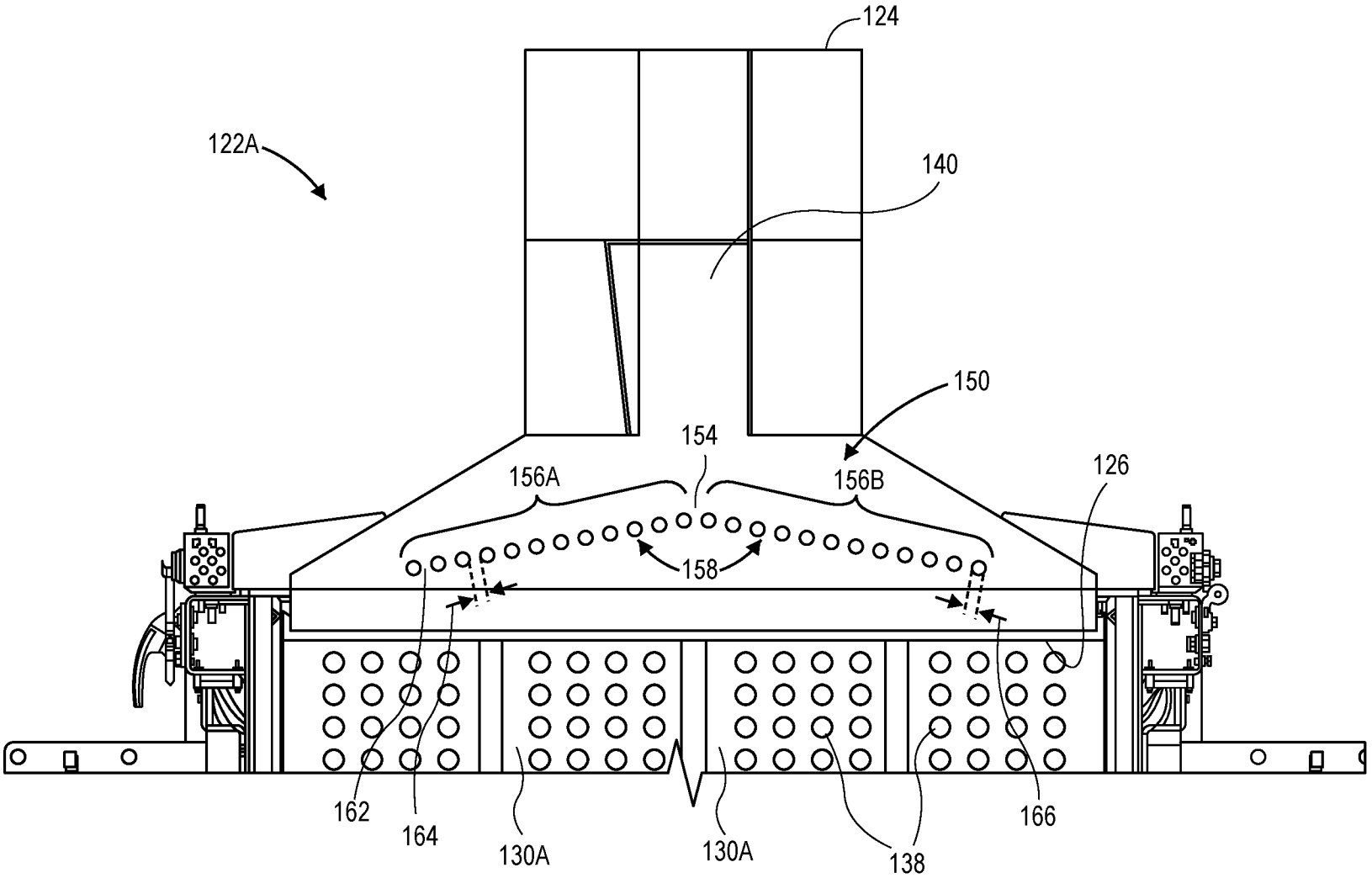
FIG. 5 illustrates a top view of the upper deck inlet, according to an embodiment.

FIG. 5 illustrates a top view of the upper deck inlet 122A, according to an embodiment. The spreader 150 may be substantially V-shaped and include a point 154 and two arms 156A, 156B. The point 154 may be positioned closer to the upstream end 124 of the upper deck inlet 122A than the downstream end 126 of the upper deck inlet 122A. Thus, distal ends of the arms 156A, 156B may be positioned closer to the downstream end 126 of the upper deck inlet 122A than the point 154. The arms 156A, 156B may be oriented in some examples at an angle 158 with respect to one another from about 90° to about 179°, about 135° to about 175°, or about 150° to about 170°.

As a result of this V-shape, the material may flow down the sloped pan 140 toward the spreader 150. The point 154 of the spreader 150 may be positioned in a middle portion along the width 141 of the pan 140 such that about half of the material contacts the spreader 150 on one side of the point 154, and about half of the material contacts the spreader 150 on the other side of the point 154. Thus, about half of the material may be directed along one arm 156A of the spreader 150, and about half of the material may be directed along the other arm 156B of the spreader 150.

As shown, the spreader 150 may not extend across the full width 141 of the pan 140. Rather, the spreader 150 (e.g., the arms 156A, 156B) may extend across in some examples from about 50% to about 95%, about 60% to about 90%, or about 70% to about 85% of the width 141 of the pan. In another embodiment, the spreader 150 (e.g., the arms 156A, 156B) may extend across the full width 141 of the pan 140.

A gap 162 may be defined between each two adjacent studs 152. In one embodiment, the width 164 of each gap 162 may remain substantially constant proceeding from the point 154 to the distal ends of the arms 156A, 156B. However, in the embodiment shown, the widths 164 of the gaps 162 may increase proceeding from the point 154 to the distal ends of the arms 156A, 156B. In other words, the width 164 of a gap 162 between two adjacent studs 152 that are proximate (e.g., closer) to the point 154 may be less than the width 164 of a gap 162 between two adjacent studs 152 that are proximate (e.g., closer) to the distal ends of the arms 156A and/or 156B. This may facilitate spreading the material evenly across the width 141 of the pan 140.

A width 166 of the studs 152 may in some examples range from about 1 mm to about 2 cm, about 2 mm to about 1.5 cm, or about 3 mm to about 1 cm. The width 166 of the studs 152 may be measured in a direction that is parallel to the width 141 of the pan 140, or it may be measured in a direction that is parallel with one or both arms 156A, 156B of the spreader 150. A ratio of the width 166 of the one of the studs 152 to the width 164 of one of the gaps 162 may in some examples be from about 1:1 to about 1:5, about 1:1 to about 1:4, about 1:1 to about 1:3, or about 1:1 to about 1:2. As will be appreciated, in embodiments where the widths 164 of the gaps 162 vary proceeding from the point 154 to the distal ends of the arms 156A, 156B, the ratio may also vary such that the ratio may be smaller (e.g., about 1:1) proximate to the point 154 and larger (e.g., about 1:5) proximate to the distal ends of the arms 156A, 156B.

The studs 152 may have a cross-sectional shape that is rounded (e.g., substantially circular). Having a rounded cross-sectional shape may result in a larger surface area on the upstream side of the studs 152 that is contacted by the material, which may reduce the rate at which the studs 152 are worn down over time due to contact with the flowing material, which can be abrasive. However, in other embodiments, the cross-sectional shape may be ovular, elliptical, square, rectangular, or the like.

Figure 6:
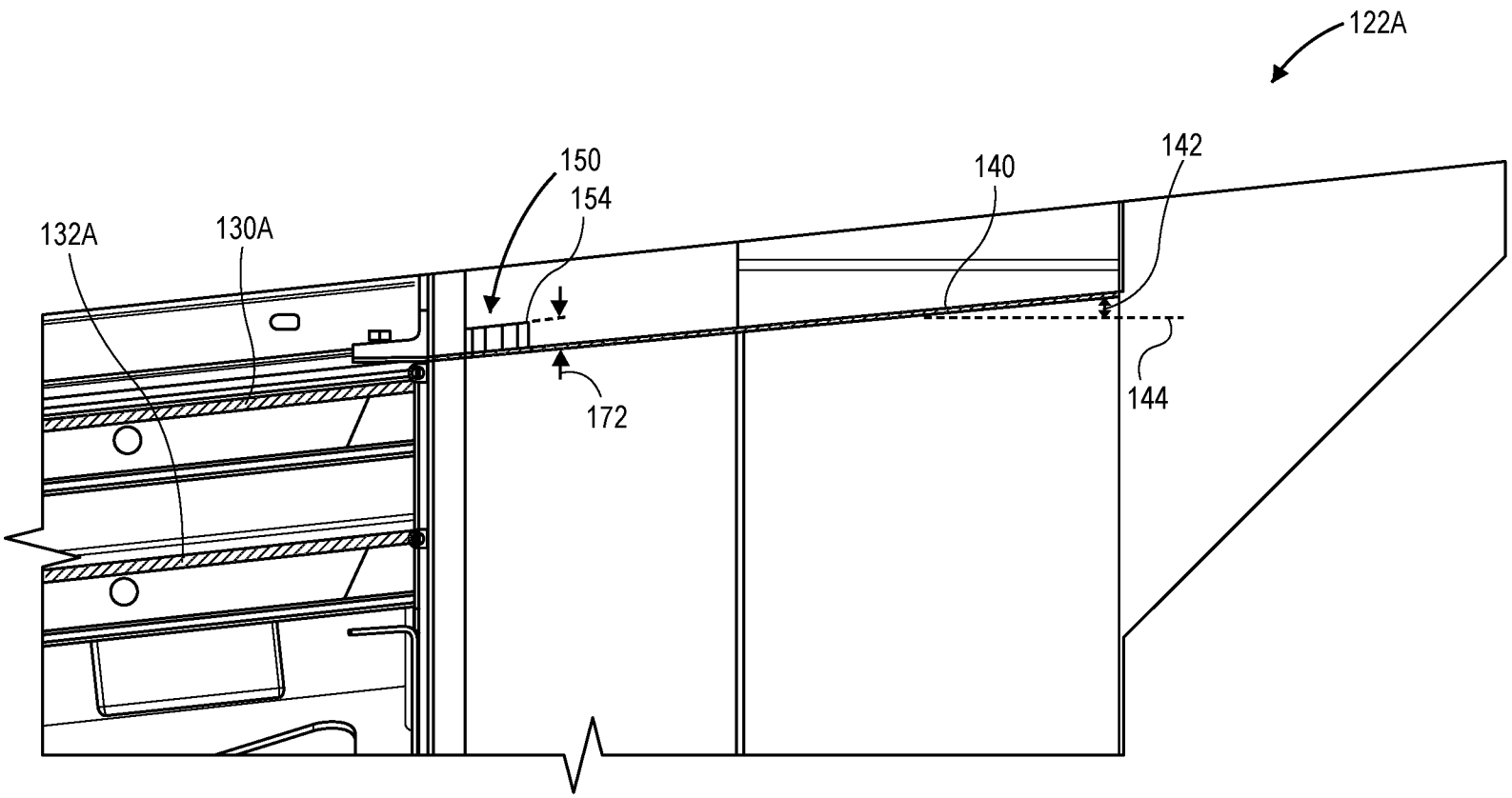
FIG. 6 illustrates a cross-sectional side view of the upper deck inlet, according to an embodiment.

FIG. 6 illustrates a cross-sectional side view of the upper deck inlet 122A, according to an embodiment. As mentioned above, the pan 140 may in some examples be tilted or sloped at an angle 142 from about 2° to about 20° or about 4° to about 10° with respect to a horizontal plane 144. This tilt may cause the material to flow down the pan 140 toward the upper screen 130A and/or the spreader 150.

In one example, a central longitudinal axis through one or more of the studs 152 may be substantially perpendicular to the pan 140. Thus, the central longitudinal axis may in some examples be oriented at an angle from about 2° to about 10° or about 4° to about 8° with respect to a vertical axis. In another example, the central longitudinal axis may be substantially parallel to the vertical axis.

A height 172 of the spreader 150 (e.g., of the studs 152) may be substantially constant proceeding from the point 154 to the distal ends of the arms 156A, 156B. In another embodiment, the height 172 may decrease proceeding from the point 154 to the distal ends of the arms 156A, 156B. The height 172 may be selected based at least partially upon the width 141 of the pan 140, the width 166 of the studs 152, the widths 164 of the gaps 162, the volumetric flow rate of the material flowing into and/or through the upper deck inlet 122A, or a combination thereof. For example, the height 172 of the spreader 170 (e.g., of the studs 152) may in some examples range from about 5 mm to about 3 cm, about 1 cm to about 2.5 cm, or about 1.5 cm to about 2 cm.

The height 172 may be selected such that the material flows through the gaps 162, but not over the studs 152, when the flow rate of the material is below a predetermined rate. The height 172 may also be selected such that the material flows through the gaps 162 and over the studs 152 when the flow rate of the material is above the predetermined rate (e.g., a surge of material). This may help to prevent a blockage in the housing inlet 112.

Figure 7:
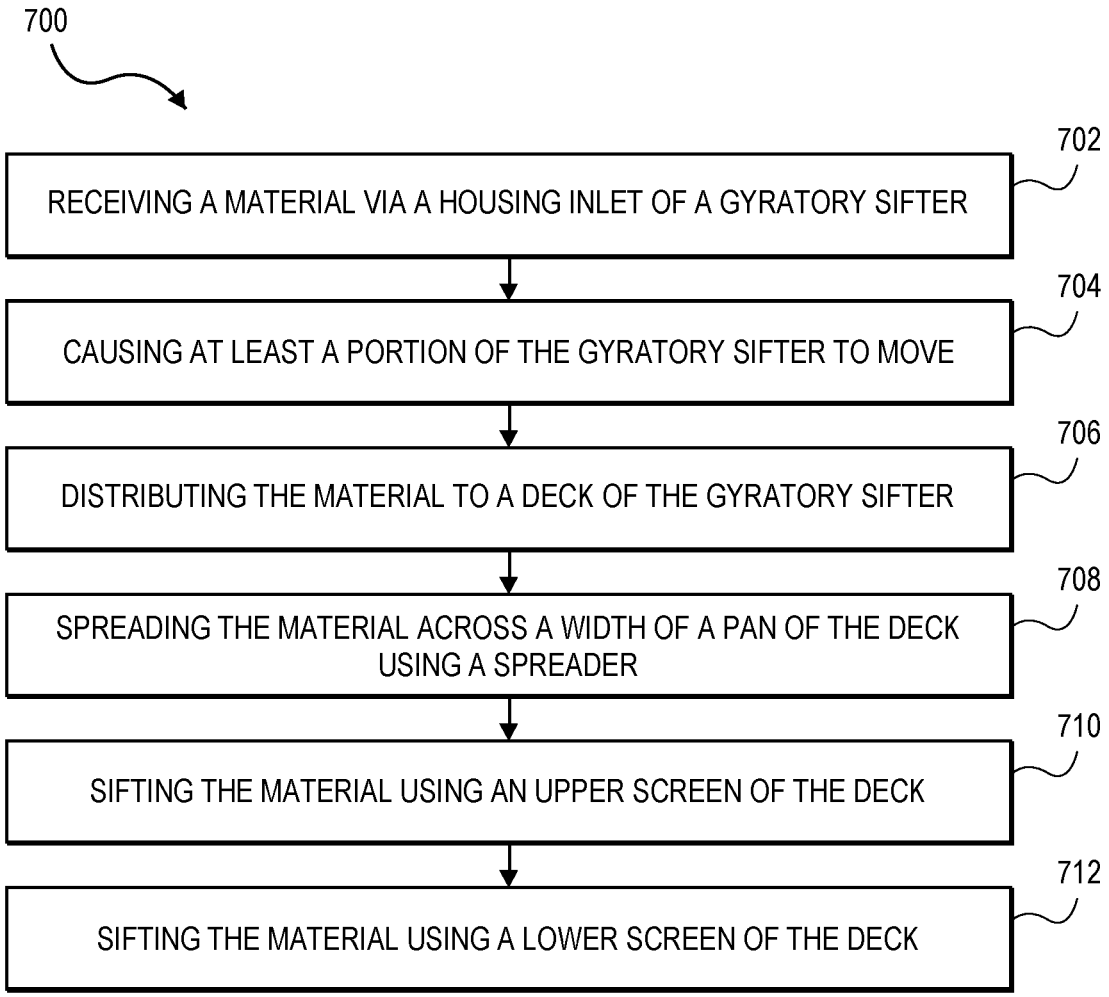
FIG. 7 illustrates a flowchart of a method for sifting a material, according to an embodiment.

FIG. 7 illustrates a flowchart of a method 700 for sifting (e.g., filtering) the material, according to an embodiment. The method 700 is described with reference to the gyratory sifter 100 described above; however, one or more portions of the method 700 may also or instead be performed using other gyratory sifters. An illustrative order of the method 700 is provided below; however, one or more portions of the method 700 may be performed in a different order or omitted.

The method 700 may include receiving the material via the housing inlet 112, as at 702. The method 700 may also include causing at least a portion of the gyratory sifter 100 to move, as at 704. The movement may be or include vibratory motion generated by the motion generator 136. The vibratory motion may be imparted to the housing inlet 112, the deck inlets 122A, 122B, the screens 130A, 132A, 130B, 132B, or a combination thereof.

The method 700 may also include distributing the material to the upper deck 120A, as at 706. The material may also be distributed to the lower deck 120B. The vibratory motion may facilitate the distribution of the material to the decks 120A-120F. The material may be distributed in substantially equal amounts to each deck 120A-120F using the splitter.

The method 700 may also include spreading the material across the width 141 of the pan 140 using the spreader 150, as at 708. The vibratory motion may facilitate the spreading of the material across the width 141 of the pan 140. The material may flow down the pan 140 toward the spreader 150. As mentioned above, the point 154 of the spreader 150 may be located in a middle portion of the width 141 of the pan 140 such that about half of the material contacts the spreader 150 on one side of the point 154, and the other half of the material contacts the spreader 150 on the other side of the point 154.

A portion of the material may flow through the gaps 162 between the inner studs 152 (e.g., the stud 152 that is located at the point 154 and the two studs 152 on either side thereof). Due to the slope of the pan 140 and/or the V-shape of the spreader 150, a remainder of the material may flow outward along the arms 156A, 156B of the spreader 150. As will be appreciated, additional portions of the material may flow through the gaps 162 between each pair of adjacent studs 152 proceeding outwardly along the arms 156A, 156B of the spreader 150. In this manner, the material may be spread (e.g., divided) substantially evenly along the width 141 of the pan 140 and/or the width 131 of the upper screen 130A.

In an example, there may be eleven studs 152, with one at the point 154, and five making up each arm 156A, 156B. Thus, in this example, there may be ten gaps 162 between studs 152 (e.g., five gaps 162 on each arm 156A, 156B). A substantially equal portion of the material (e.g., 10%) may flow through each of the ten gaps 162. This may be at least partially due to a volumetric flow rate of the material into/through the upper deck inlet 122A, the width 141 of the pan 140, angle 142 at which the pan 140 is oriented, the shape of the spreader 150 (e.g., V-shaped), the shape of the studs 152 (e.g., rounded), the width 166 of the studs 152, the widths 164 of the gaps 162, the height 172 of the studs 152, or a combination thereof.

Instead of, or in addition to, causing a substantially equal portion of the material to flow through each of the gaps 162, the spreader 150 may cause different amounts of material to flow through each of the gaps 162. However, the spreader 150 may cause the material to be spread substantially equally across the width 141 of the pan 140 and/or the width 131 of the upper screen 130A. More particularly, the spreader 150 may result in the material being spread substantially equally across the width 131 of the upper screen 130A starting at/proximate to an upstream end 134 of the upper screen 130A (see FIG. 5). This may increase the surface area of the upper screen 130A and/or the lower screen 132A that is used to sift (e.g., filter) the material. In addition, by spreading the material substantially evenly across the width 131 of the upper screen 130A, the upper screen 130A may be able to sift (e.g., filter) the material more efficiently and at a faster rate.

The method 700 may also include sifting the material using the upper screen 130A, as at 710. The vibratory motion may facilitate the sifting of the material using the upper screen 130A. The solid particles that are larger than the openings 138 in the upper screen 130A, and thus cannot pass through the upper screen 130A (i.e., the overs), may be directed to the first housing outlet 114. The solid particles that pass through the upper screen 130A land on the lower screen 132A.

The method 700 may also include sifting the material using the lower screen 132A, as at 712. The vibratory motion may facilitate the sifting of the material using the lower screen 130B. The solid particles that are larger than the openings in the lower screen 132A, and thus cannot pass through the lower screen 132A (i.e., the unders), may be directed to the second housing outlet 116. The solid particles that pass through the openings in the lower screen 132A (i.e., the fines) may be directed to the third housing outlet 118.

The decks 120A-120F may operate in series or parallel. When the decks 120A-120F operate in parallel, the portions of the method 708-712 may occur substantially simultaneously for each deck 120A-120F.

The foregoing description, for purposes of explanation, used specific nomenclature to provide a thorough understanding of the disclosure. However, it will be apparent to one skilled in the art that the specific details are not required in order to practice the systems and methods described herein. The foregoing descriptions of specific examples are presented for purposes of illustration and description. They are not intended to be exhaustive of or to limit this disclosure to the precise forms described. Many modifications and variations are possible in view of the above teachings. The examples are shown and described in order to best explain the principles of this disclosure and practical applications, to thereby enable others skilled in the art to best utilize this disclosure and various examples with various modifications as are suited to the particular use contemplated. It is intended that the scope of this disclosure be defined by the claims and their equivalents below.

What is claimed is:

1. A deck inlet for a sifter, comprising:

a pan that is oriented at an angle from about 2° to about 20° with respect to a horizontal plane; and a spreader coupled to or integral with an upper surface of the pan, wherein the spreader is configured to spread a material substantially evenly across a width of the pan and, wherein the spreader is substantially V-shaped and points toward an upstream end of the pan.

2. The deck inlet of claim 1, wherein the spreader is configured to spread the material substantially evenly across a width of a screen that is positioned downstream from the pan.

3. The deck inlet of claim 1, wherein the spreader comprises a first arm and a second arm that are oriented at an angle with respect to one another from about 90° to about 179°.

4. The deck inlet of claim 1, wherein the spreader extends from about 60% to about 90% across the width of the pan.

5. The deck inlet of claim 1, wherein the spreader comprises a plurality of studs that extend upward from the upper surface of the pan, and wherein each pair of adjacent studs defines a gap therebetween.

6. The deck inlet of claim 5, wherein a ratio of a width of one of the studs to a width of one of the gaps is from about 1:1 to about 1:5.

7. The deck inlet of claim 5, wherein a width of a first gap is less than a width of a second gap, and wherein the first gap is closer to a middle portion of the spreader than the second gap.

8. The deck inlet of claim 5, wherein the studs comprise a first stud and a second stud, wherein a height of the first stud is greater than a height of the second stud, and wherein the first stud is closer to a middle portion of the spreader than the second stud.

9. The deck inlet of claim 5, wherein the studs each have a substantially circular cross-sectional shape.

10. A gyratory sifter, comprising:

a housing;

an upper deck positioned at least partially within the housing, the upper deck comprising:

an upper deck inlet, wherein the upper deck inlet comprises:

a pan that is oriented at an angle from about 2° to about 20° with respect to a horizontal plane; and a spreader coupled to or integral with an upper surface of the pan, wherein the spreader is substantially V-shaped and facing an upstream end of the pan;

a first upper screen positioned downstream from the upper deck inlet, wherein the spreader is configured to spread a material substantially evenly across a width of the first upper screen; and a first lower screen positioned at least partially below the first upper screen;

a lower deck positioned at least partially within the housing and below the upper deck, wherein the lower deck comprises:

a lower deck inlet;

a second upper screen positioned downstream from the lower deck inlet; and a second lower screen positioned at least partially below the second upper screen; and a motion generator positioned at least partially within the housing, wherein the motion generator is configured to cause the upper deck and the lower deck to move.

11. The gyratory sifter of claim 10, wherein the spreader comprises a first arm and a second arm that are oriented at an angle with respect to one another from about 90° to about 179°.

12. The gyratory sifter of claim 11, wherein a height of the spreader decreases proceeding from the point along the first arm, from the point along the second arm, or both.

13. The gyratory sifter of claim 12, wherein the spreader comprises a plurality of studs that extend upward from the upper surface of the pan, wherein a cross-sectional shape of the studs is at least partially rounded, wherein each pair of adjacent studs defines a gap therebetween, and wherein a ratio of a width of one of the studs to a width of one of the gaps is from about 1:1 to about 1:2.

14. The gyratory sifter of claim 13, wherein the width of the gaps decreases proceeding from the point along the first arm, from the point along the second arm, or both.

15. A method for sifting a material, comprising:

receiving the material via a housing inlet of a vibratory sifter;

causing at least a portion of the vibratory sifter to move;

distributing the material from the housing inlet to an upper deck of the vibratory sifter and a lower deck of the vibratory sifter, wherein the upper deck and the lower deck each comprise a pan, a spreader, and a screen;

spreading the material across a width of the screen of the upper deck using the spreader of the upper deck; and sifting the material using the screen of the upper deck to produce a first portion of the material and a second portion of the material.

16. The method of claim 15, wherein the spreader of the upper deck is substantially V-shaped and comprises a point and two arms extending from opposing sides thereof, wherein the spreader of the upper deck comprises a plurality of studs, wherein each pair of adjacent studs defines a gap therebetween.

17. The method of claim 16, wherein a width of the gaps increases proceeding from the point along the two arms to distribute the material substantially evenly along the width of the screen of the upper deck.

18. The method of claim 17, wherein a height of the spreader of the upper deck decreases proceeding from the point along the two arms to distribute the material substantially evenly along the width of the screen of the upper deck.

19. The method of claim 18, wherein the material flows through the gaps, but not over the studs, when a flow rate of the material is less than a predetermined rate, and wherein the material flows through the gaps and over the studs when the flow rate of the material is greater than the predetermined rate.

* * * * *